US006280110B2

(12) United States Patent
Lin

(10) Patent No.: US 6,280,110 B2
(45) Date of Patent: Aug. 28, 2001

(54) PRESSING DEVICE FOR A PEN

(76) Inventor: Casio Lin, 5F, No.16, Alley 65, Lane 14, Sec. 7, Chung San N. Road, Taipei (TW)

( * ) Notice: Subject to any disclaimer, the term of this patent is extended or adjusted under 35 U.S.C. 154(b) by 0 days.

(21) Appl. No.: 09/742,066

(22) Filed: Dec. 22, 2000

(51) Int. Cl.[7] ..... B43K 5/17; B43K 7/12; B43K 24/04; B43K 24/12

(52) U.S. Cl. ..... 401/106; 401/104; 401/111; 401/112; 401/180

(58) Field of Search ..... 401/106, 105, 401/104, 111, 112, 117, 179–181

(56) References Cited

U.S. PATENT DOCUMENTS 3,819,282 * 6/1974 Schultz ..... 401/105
5,413,428 * 5/1995 Kageyama ..... 401/104 X
5,871,296 * 2/1999 Furukawa et al. ..... 401/106
5,915,866 * 6/1999 Furukawa ..... 401/106
5,918,993 * 7/1999 Koyama ..... 401/106

* cited by examiner

*Primary Examiner*—Gregory L. Huson
*Assistant Examiner*—Kathleen J. Prunner
(74) *Attorney, Agent, or Firm*—Dougherty & Troxell

(57) ABSTRACT

A pressing device for a pen having a spring, a center stick engaging the spring and a nib part. The pressing device comprises a penholder having a guide slot, a movable tube having an outwardly projecting engaging piece that extends through the guide slot, a bounce device, a press or push cap, and a clipping part. The clipping part has a pen clip provided with a clamping piece that engages the engaging piece when the nib part is extended outwardly from the penholder in a writting position. When the pen is being attached to an article such as a pocket, the clamping piece will touch the article such that the pen clip is urged to move outward. As a result, the clamping piece will disengage the engaging piece. The engaging piece will move upward along the guide slot causing the spring to be stretched pressing the center stick upward such that the nib part will be received in the penholder.

2 Claims, 5 Drawing Sheets

PRESSING DEVICE FOR A PEN

BACKGROUND OF THE INVENTION

1. Field of the Invention

The present invention relates to a pressing device for a pen. In particular, the present invention relates to a pressing device arranged in a pen, with which the pen clip may move outward to separate an engaging piece on a movable tube from a clamping piece to move the movable tube upward. Thus, the nib part on the pen can retreat into the penholder and avoid staining a clipped article in the case where the pen is clipped to a clipped article such as a pocket or a notebook when the nib part is extended outside.

2. Description of Related Art

Writing is a principal and required function of a pen. It is undoubted that a consideration concerning how to be carried about with the user is worth it for us to care except for the function of writing and the way the pen is used. After all, we need to use a pen wherever we are. The most common way to enhance the portability of a pen is to add a pen cap or pen clip on the pen so that it is possible for the pen to clip to a pocket on clothes or a book.

Although the added pen cap or pen clip can offer an expected function for a pen being carried about, there is a shortcoming needed to overcome. For instance, a push type of pen with a pen clip usually has a press cap to be pushed downward so as to displace a bounce device. Thus, a rotary key in the pen may press a key rib part at the top of the pen during rotation such that the center stick and a spring therein are urged to expose the nib part of the center stick for writing. The nib part of the center stick is disposed downward while the preceding push type of pen is clipped to the pocket. However, the exposed nib part may stain the cloth of the pocket with ink if the user forgets to move the nib part of the clipped pen backward in the penholder. Especially, it is much more serious in the case where a pen with liquid ink or a steel ball is clipped to the clothes. The liquid ink is easily absorbed by the cloth and permeates the cloth fiber so that it is hard to clean up once the cloth is stained. Therefore, it is a subject that has to be broken through so that the nib part can move backward in the penholder during the pen being clipped.

SUMMARY OF THE INVENTION

An object of the present invention is to provide a pressing device for a pen, which has a structure to move the nib part of the center stick automatically while the nib part touches a clipped article so as to avoid the ink in the pen staining the clipped article.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
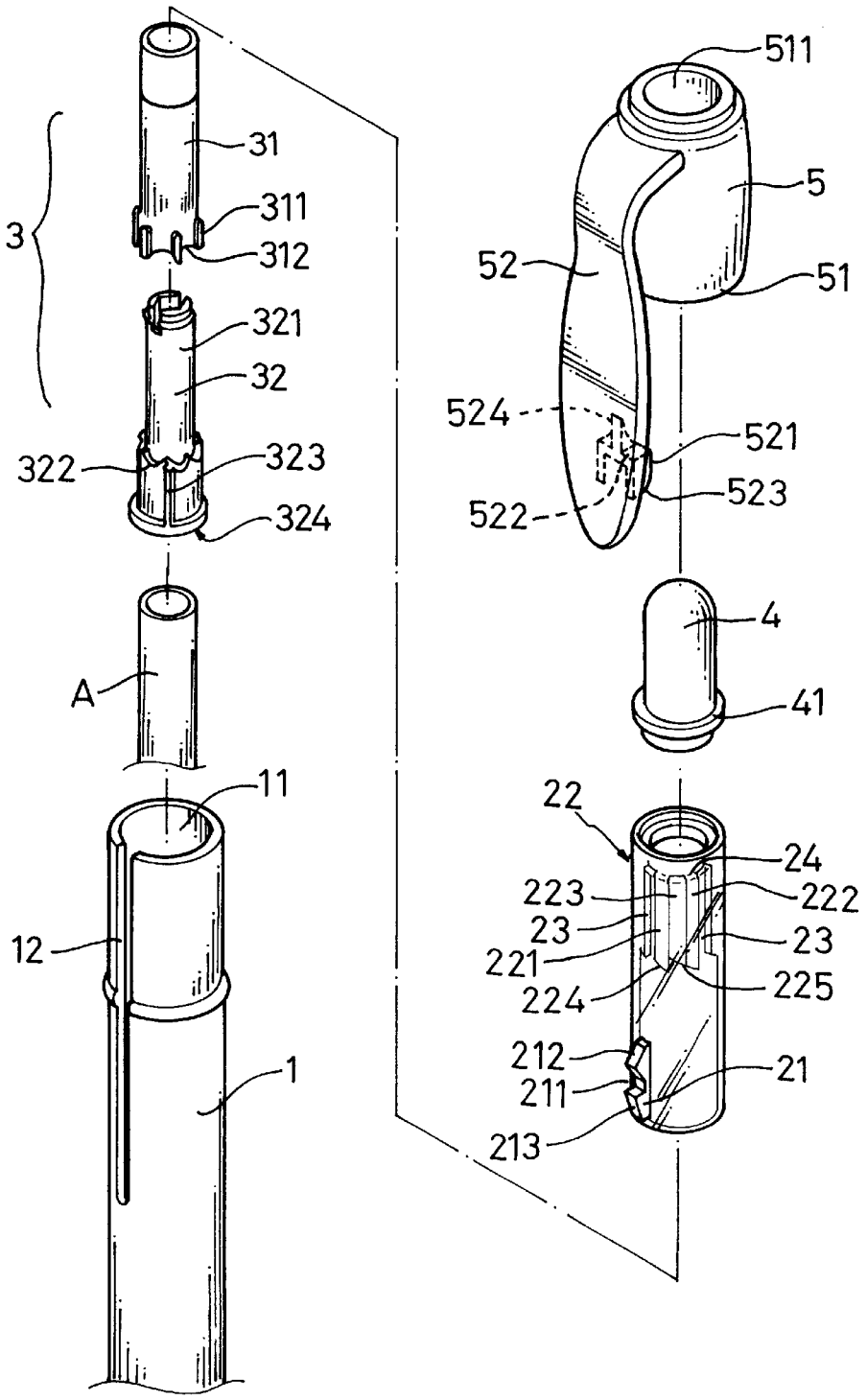
FIG. 1 is an exploded perspective view of a pressing device for a pen according to the present invention.

Referring to FIG. 1, a pressing device for a pen according to the present invention basically comprises a penholder 1, a movable tube 2, a bounce device 3, a push or press cap 4, and a clipping part 5. The pen has a spring therein to fit with a center stick A and a nib part thereof is actuated by the bounce device 3 to extend outward of the lower end of the pen or to retreat backward in the pen. The outward or inward movement of the nib part is prior art so that no further details will be described.

The penholder 1 has a hollow body and the upper end thereof has an open end 11. A guide slot 12 extends downward along the wall thereof from the open end 11.

The movable tube 2 has an outer diameter thereof corresponding to the inner diameter of the open end 11 and the length thereof is shorter than the guide slot 12. The movable tube 2 at the lower end thereof provides an outer engaging piece 21 which passes through the guide slot 12 so as to be displaced along the guide slot 12. The engaging piece 21, at the middle thereof, has a V shaped recess 211 and at the top and the bottom thereof has a slant plane 212 and 213 respectively. Besides, the movable tube 2, at the upper part thereof, provides a conventional inner locating device. The locating device is composed of a plurality of key rib parts 22 and key grooves 23 alternately spaced with respect to each other. Each key rib part 22 consists of a left rib 221, a right rib 222, and a middle rib 223, and the middle rib 223 has a minor recess at the center thereof. Both the left rib 221 and the right rib 222, at the respective bottom, have a slant rib 224 and a slant post 225. In addition, each rib part 22, at the top thereof, has a stop ring 24 which abuts against the bounce device 3 to prevent the rib part 22 from moving away.

The bounce device 3 is a known art device and it is composed of a stationary key 31 and a rotary key 32 fitting with each other. The stationary key 31, at the lower part thereof, provides a plurality of projections 311 received in the middle key ribs 223 and the key grooves 23, and said projections 311 are limited by the stop ring 24 during upward movement. Besides, the projections 311, at the bottom thereof, have upper matching teeth 312. The rotary key 32, at the upper portion thereof has a cylinder part 321 fitting with the stationary key 31 and, at the lower part thereof, provides lower matching teeth 322 to mesh with the upper matching teeth 312. Furthermore, a plurality of lock keys 323 are provided on the lower part of the rotary key 32 to be received in the key grooves 23. In addition, a stop flange 324 is provided at the lower end of the rotary key 32 to connect with the center stick A. Once the stop flange 324 touches the lower end of the respective rib part 22, upward movement of rotary key 32 is limited.

The press or push cap 4 is a covering lid and fits with the movable tube 2 and the stationary key 31 respectively. The outer surface of press cap 4 is surrounded with a stop ring 41.

The clipping part 5 provides a hollow seat 51 to engage with the open end 11 of the penholder 1 and an upper opening 511 in the clipping part 5 is for the press cap 5 extending outward to press against the stop ring 41. Besides, a pen clip 52 extends laterally from the hollow seat 51 and a clamp piece 521 juts out from the free end of the pen clip 52 at the inner wall thereof. The clamp piece 521, at the center thereof, provides a transverse tenon 522 and a lateral side of the tenon 522 is provided with a downward circular edge 523 at both ends thereof. The other lateral side of the tenon 522 provides an angle projection 524.

Referring to FIG. 1 again, the procedure of assembling the preceding parts is explained hereinafter. First of all, the hollow seat 51 is engaged to the open end 11 and then the stationary key 31 and the rotary key 32 are joined together before being inserted in the movable tube 2. The stationary key 31, at the top thereof, fits engages with the press cap 4 such that the movable tube 2, at the top end thereof, can engage the press cap 4. Furthermore, the engaging piece 21 is aligned with the guide slot 12 to allow the bounce device 3, the movable tube 2 and the press cap 4, which connect with one another in series, to be inserted into the penholder 1 from the open end 11. In this way, the stop flange 324 can engage or press against the center stick A. At this moment, the slant plane 213, at the bottom of the engaging piece 21, moves along the angle projection 524 on the clamp piece 521. While the transverse tenon 522, the angle projection 524 and the V shaped recess 211 are in a state of engagement, the movable tube 2 has been located at a lateral side of the pen clip 52 and the assembling job is entirely complete.

When the pen is used for writing, the bounce device 3 is pushed downward to press the center stick A and the spring respectively, forward. Hence, the lock keys 323 may move toward the middle key ribs 223 while passing over the slant posts 225 on the right ribs 222. The lower meshing teeth 322 are rotated with respect to the upper meshing teeth 312 to press the lock keys 323 against the middle key ribs 223. At this moment, the rotary key 32 is in a state of stretching to urge the nib part of the center stick outward from the penholder 1 for writing.

Figure 5:
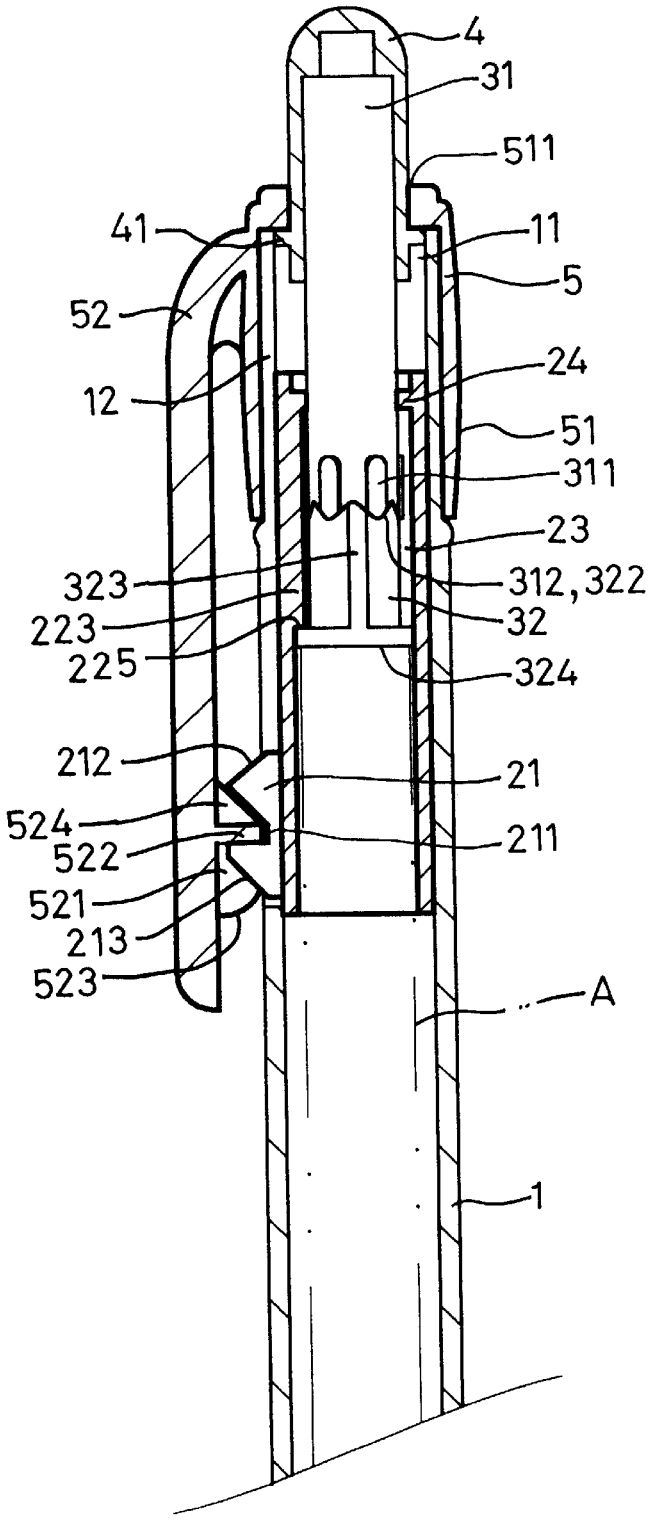
FIG. 5 is a sectional view illustrating the state of moving the center stick backward in the penholder.

Referring to FIG. 5, when the pen is not in use, the press cap 4 is pushed again and the bounce device 3 is actuated in the rib parts 22 and the key grooves 23 to move the nib part on the center stick A into the penholder 1.

Figure 2:
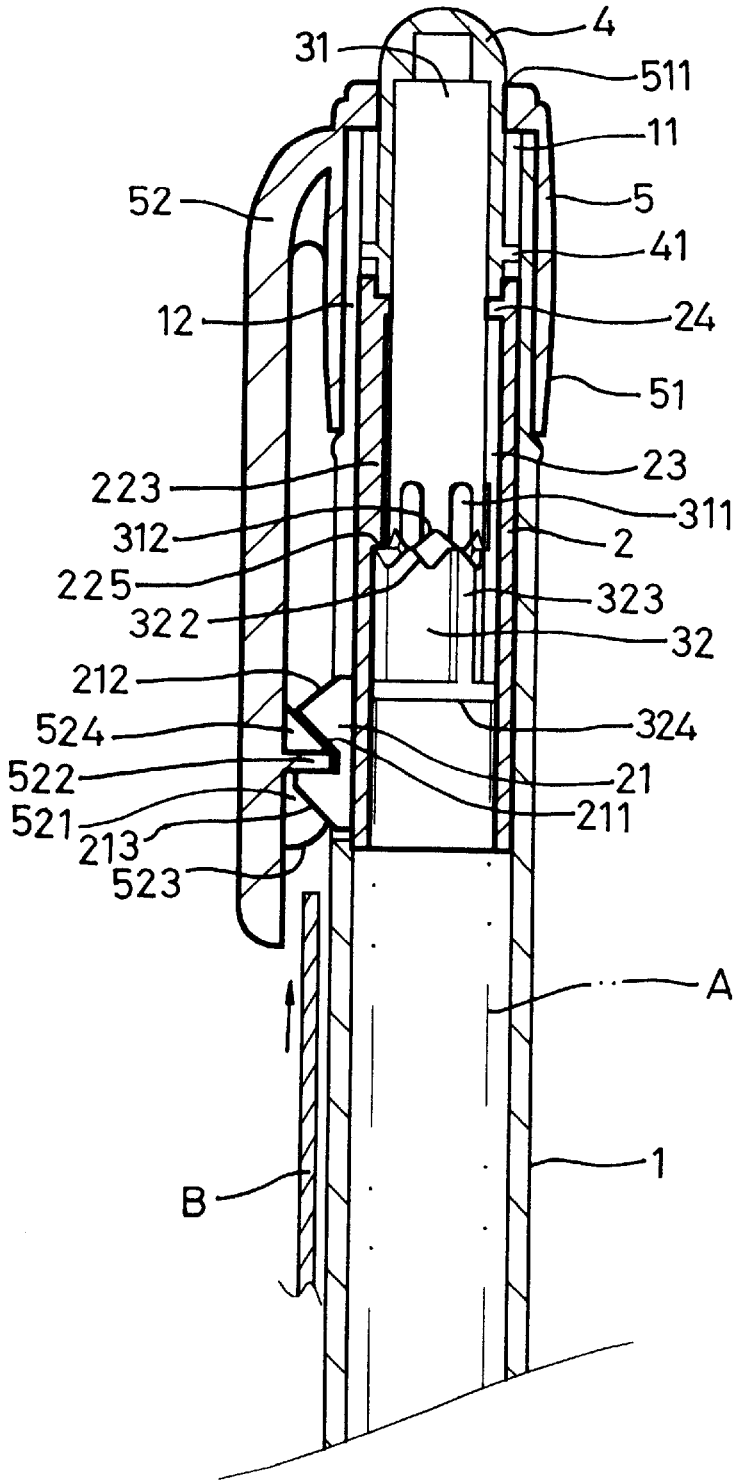
FIG. 2 is an assembled sectional view of the pressing device shown in FIG. 1 illustrating the pen being in a state of being used for writing.
Figure 3:
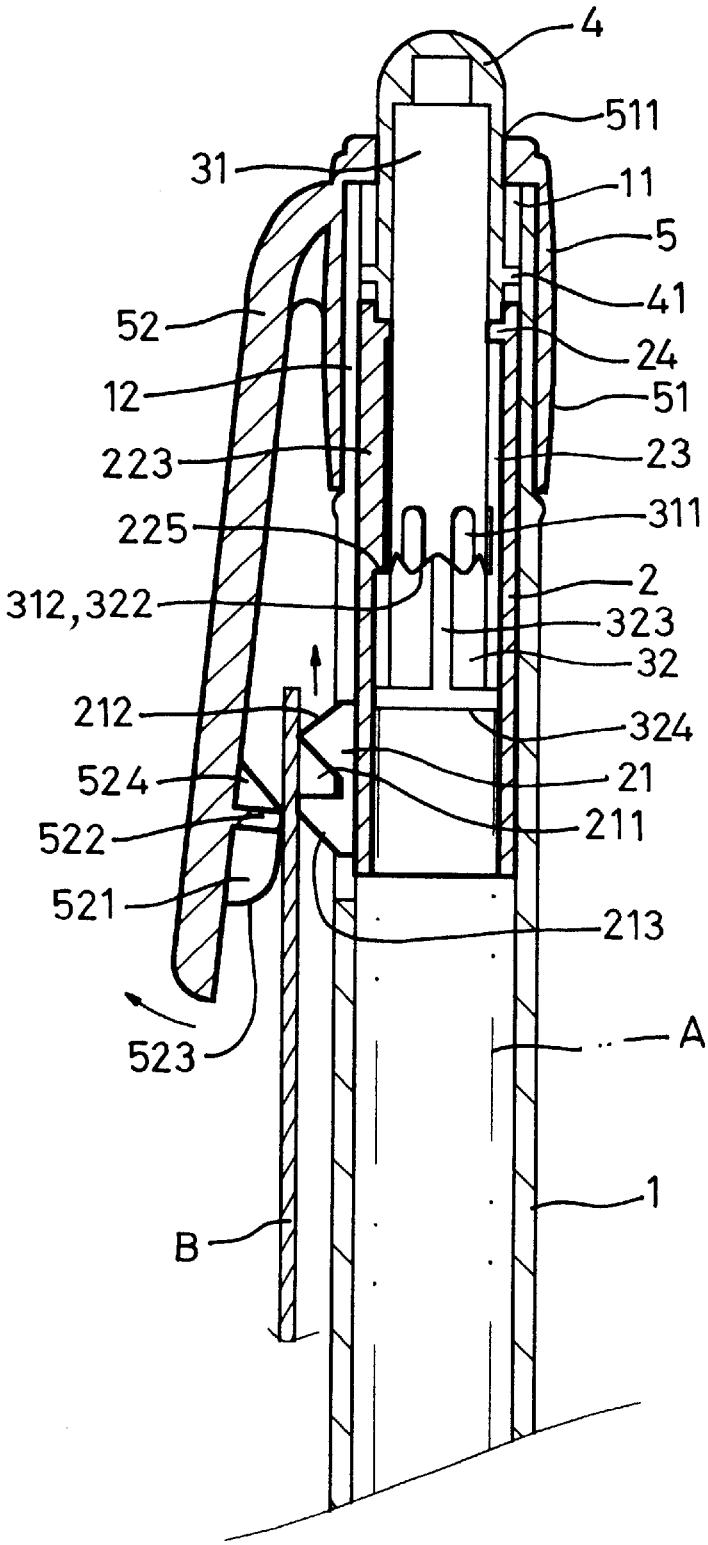
FIG. 3 is a sectional view illustrating the pen of the present invention at the time of clipping to a clipped article.
Figure 4:
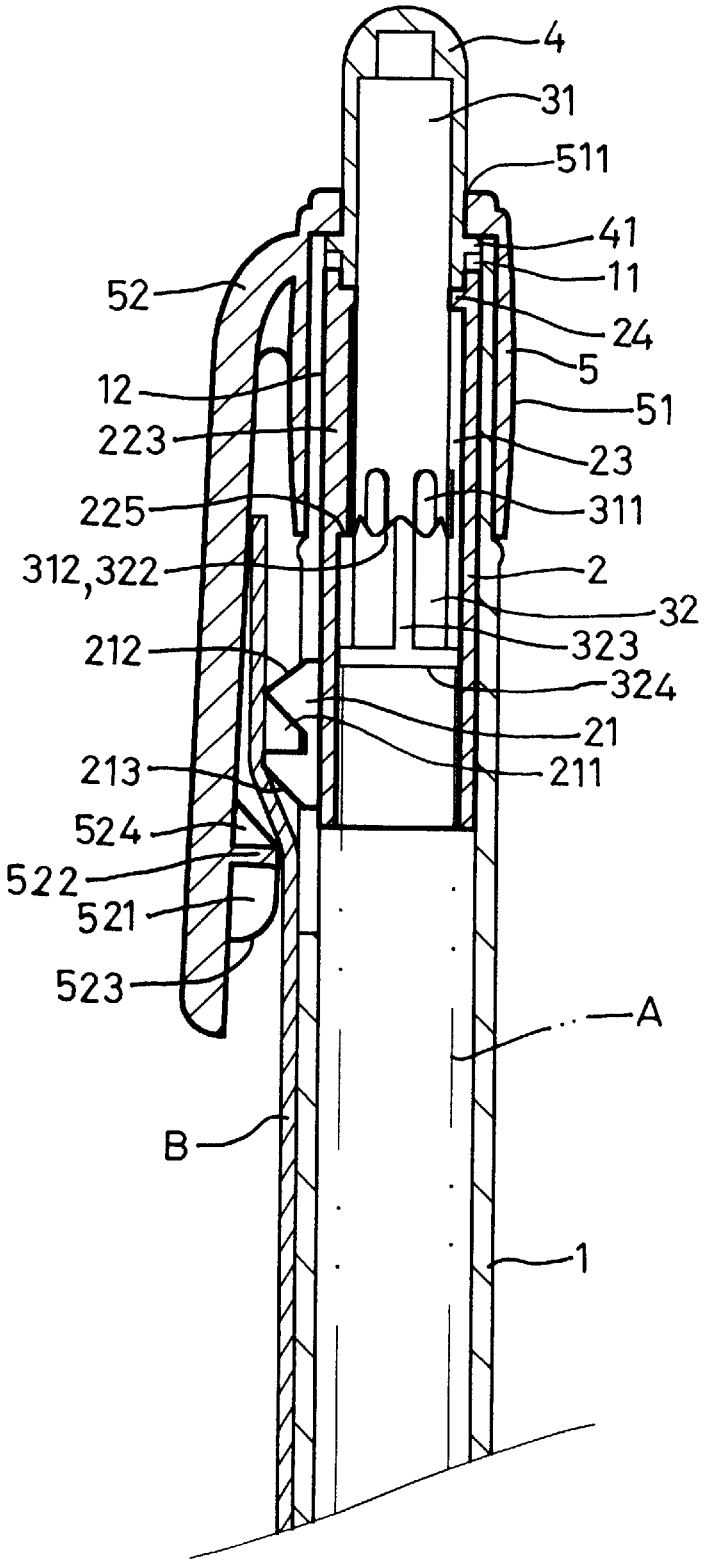
FIG. 4 is a sectional view illustrating the pen of the present invention having been clipped to a clipped article.

Referring to FIGS. 2 to 4, the operation concerning clipping the pen to a pocket on a piece of clothing (it will be designated as a clipped article B hereinafter) in the case where the nib part is projected outward of the penholder 1 will be explained hereinafter. When the circular edges 523 of the clamp piece 521 are moved to touch the clipped article B, as shown in FIG. 2, the clipped article B may contact the slant plane 213 along the circular edges 523 to urge the clip 52 outward. Thus, the tenon 522 and the angle projection 524 may move away from the V shaped recess 211 immediately to free them from engagement as shown in FIG. 3. The movable tube 2 is pushed by the stretched spring and the center stick A to make the engaging piece 21 move upward along the guide slot 12 as shown in FIG. 4, till the stop ring 41 presses against the hollow seat 51. Thus, the top end of the movable tube 2 constitutes a locating device and the nib part on the center stick A can be received in the penholder to prevent the nib part from staining the cloth of the pocket. If the pen is going to be used for writing, it is only needed to push the press cap 4 again. Then, the engaging piece 21 of the movable tube 2 engages the clamp piece 521 on the clip 52 so as to actuate the bounce device 3 in the movable tube 2 to move the nib part of the center stick A outward from the penholder 1 again.

It can be understood from the preceding description of the preferred embodiment that the present invention provides functions overriding the prior art advantageously. When the clamp piece of the clip and the engaging piece of the movable tube contact the clipped article, the clip is urged to move outward such that the movable tube losses the function of the engagement. The stretching of spring and the pressing of the center stick moves the engaging piece upward such that the nib part of the center stick moves automatically into the penholder to avoid the ink from staining the clothes. Furthermore, the only spring in the pen is used for locating the bounce device at the locating device in the movable tube and making the engaging piece of the movable tube return to the original position at the moment of being released by the clamping piece.

While the invention has been described with reference to preferred embodiment thereof, it is to be understood that modifications or variations may be easily made without departing from the spirit of this invention, which is defined by the appended claims.

What is claimed is:

1. A pressing device for a pen having a spring, and a center stick fitting with the spring and a nib part, the pressing device comprising:

a penholder having an upper end and a lower end, and a tube body provided at an upper end thereof with an open end, and a guide slot extending downward to a depth from the open end;

a movable tube being disposed in the penholder and having a size corresponding to an inner diameter of the open end, and having a length shorter than the depth of the guide slot, an outer engaging piece provided at a bottom end of the tube so as to pass through the guide slot, and a locating device provided at a top end of the tube;

a bounce device being placed in the movable tube, a lower end of the bounce device being adapted to connect with the center stick, and providing two pushing stages of locating movements of the locating device to define an upper and a lower disposition in the penholder;

a press cap defining a covering lid, a lower part thereof fitting with the movable tube and the bounce device, respectively, and being surrounded by a stop ring; and a clipping part having a hollow seat engaging the open end of the penholder, an upper opening through which the press cap passes and against which the stop ring abuts, a pen clip extending out laterally and downwardly from the hollow seat, a clamping piece jutting out of a free end of the clip at an inner wall thereof and engaging the engaging piece extending out of the guide slot, the bounce device, and the movable tube;

whereby, when the clamping piece engages a clipped article, the pen clip is urged outward and the clamping piece disengages from the engaging piece while the engaging piece moves upward along the guide slot allowing the spring to stretch and press the center stick and movable tube upwardly against the upper opening of the clipping part; and the nib part of the center stick is then received automatically in the penholder.

2. The pressing device for a pen according to claim 1, wherein the engaging piece of the movable tube at an center thereof is provided with a V shaped recess with a slant plane being at a top and a bottom thereof respectively; the clamping piece on the pen clip is provided with a transverse tenon at a center thereof; each lateral side of the tenon is provided with a lower circular edge and an upper end having an angle projection wherein the transverse tenon and the angle projection are received in the V shaped recess when the pen clip has locked the movable tube.

* * * * *